United States Patent [19]

Burks

[11] Patent Number: 5,030,118

[45] Date of Patent: Jul. 9, 1991

[54] RETRACTABLE CONNECTOR PROTECTIVE COVER

[75] Inventor: Robert J. Burks, Dallas, Tex.

[73] Assignee: The United States of America as represented by the Secretary of the Air Force, Washington, D.C.

[21] Appl. No.: 486,587

[22] Filed: Feb. 28, 1990

[51] Int. Cl.[5] ..... H01R 13/44

[52] U.S. Cl. ..... 439/138; 174/67; 220/242; 439/135

[58] Field of Search ..... 439/135–138, 439/142, 157, 186, 271, 373, 892, 893, 934; 174/67; 220/221, 240, 242

[56] References Cited

U.S. PATENT DOCUMENTS

| | | | |
|---|---|---|---|
| 3,189,212 | 6/1965 | Bellek | 220/24.3 |
| 3,716,815 | 2/1973 | Riches | 174/67 |
| 3,763,461 | 10/1973 | Kotski | 439/138 |
| 3,982,804 | 9/1976 | Marechal | 339/41 |
| 4,036,396 | 7/1977 | Kennedy et al. | 174/67 |
| 4,138,187 | 2/1979 | Brygger | 174/67 |
| 4,361,252 | 11/1982 | Black et al. | 220/242 |
| 4,381,879 | 5/1983 | Ehrenfels et al. | 174/67 |
| 4,385,792 | 5/1983 | Baur et al. | 439/135 |
| 4,784,610 | 11/1988 | Stuart | 439/144 |
| 4,836,794 | 6/1989 | Barr | 439/135 |
| 4,932,673 | 6/1990 | Domnikov et al. | 439/271 |
| 4,952,160 | 8/1990 | Olsen | 439/271 |

FOREIGN PATENT DOCUMENTS

| | | | |
|---|---|---|---|
| 0232792 | 8/1987 | European Pat. Off. | 439/138 |

*Primary Examiner*—Paula A. Bradley

*Attorney, Agent, or Firm*—Jacob N. Erlich; Donald J. Singer

[57] ABSTRACT

An electrical socket cover is disclosed in a system which includes a pair of connector elements which may be electrically engaged, and a cover for protection of a first connector element when the first and second connector elements are disengaged. The first connector element is mounted on a vertical wall of an enclosure, while the second connector element which comprises an electronic module is movable longitudinally within the enclosure between a first, engaged position and a second, disengaged position.

20 Claims, 3 Drawing Sheets

RETRACTABLE CONNECTOR PROTECTIVE COVER

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to electrical connectors and more specifically the invention pertains to an automatic cam operated shield, for a panel mounted connector, that provides protection for secure electronic information.

The introduction of computers, computer-based systems, and other electronic equipment into the office environment presents tremendous opportunities for productivity increases by managerial, technical, and administrative personnel. At the same time, it significantly increases the potential for unauthorized use of sensitive or personal information. For example, the electronics and computer industries produce many products where modules are designed to be removed to vary the function of equipment or for ease of maintenance. When the connector to one of these modules is removed, it can leak electronic information signals of adjacent connectors and modules through inducted electrical emanations. These electrical emanations may radiate information in signals that can be intercepted and subsequently read by unauthorized personnel.

The task of controlling compromising electrical emanations from electronic equipment when modules are being serviced is alleviated, to some extent, by the systems disclosed in the following U.S. Patents, the disclosures of which are specifically incorporated herein by reference:

U.S. Pat. No. 3,189,212 issued to Bellek;

U.S. Pat. No. 3,982,804 issued to Marechal; and

U.S. Pat. No. 4,784,610 issued to Stuart.

The Bellek patent discloses an electrical outlet with a hinged weatherproof cover. The Marechal patent discloses a selective electrical connector. The Stuart patent describes a plug and socket electrical connector with a hinged cover for the socket. While these references are instructive, a need remains to provide a gasketted cover which can serve as an RFI shield to block electrical emanations from the connectors of electronic modules. The present invention is intended to satisfy that need.

SUMMARY OF THE INVENTION

The present invention includes a retractable protective cover system for covering and sealing an electrical socket of an electronic module when its plug is removed. The embodiment of the invention includes: a frame, a pair of hinges, a spring, a first axle, a protective cover, and a second axle. The frame has a rectangular-shaped end and a Y-shaped end with the first axle disposed through the Y-shaped end. The protective cover has an insulating gasket and is pivotally fixed to the Y-shaped end of the frame by the first axle.

The first hinge fixes the rectangular shaped end of the frame to a shelf which is perpendicular to the module, and which is in proximity with the socket. The second hinge is pivotally fixed to the second axle, and to the module. The spring is fixed between the shelf and the frame and pushes the frame downwards. The downward movement of the frame creates a moment which extends the protective cover towards the socket.

The cam is fixed to the bottom of the frame such that when a plug is inserted in the socket, the plug presses against the cam and pushes the frame upward. The upward movement of the Y-shaped end of the frame causes the cover to be retracted away from the socket.

It is an object of the present invention to provide an automatic cam operated shield that covers the sockets of electronic modules when their plugs are removed.

It is another object of the present invention to provide an RFI gasketted cover system to protect secure electronic information by covering sockets when their plugs are removed.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes a retractable protective cover for electrical connectors which serves as a radio frequency interference (RFI) shield and blocks electrical emanations from the sockets of electronic modules. The reader's attention is now directed towards FIG. 1, which is a plan view of the present invention, and which depicts most of the invention's key elements.

Figure 1:
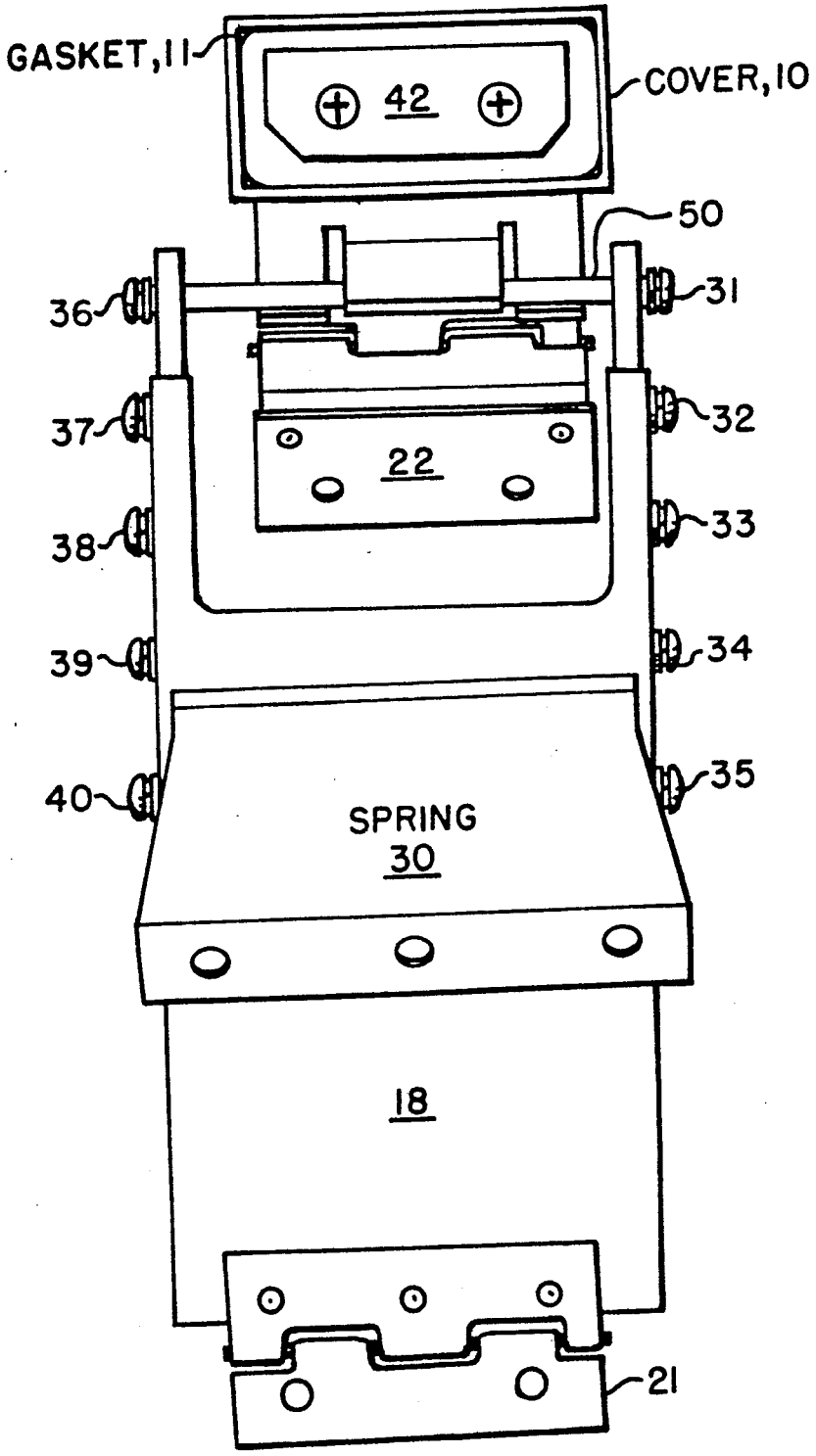
FIG. 1 is a plan view of the present invention.

The system of FIG. 1 includes: a frame 18, a spring 30, two hinges 21 and 22, and an RFI cover 10. As shown, the frame 18 has a rectangular-shaped end on one end, and an end shaped somewhat like a capital letter Y at its other end. The first hinge 21 is fixed to the rectangular-shaped and of the frame 18, while the second hinge 22 and the RFI cover 10 are pivotally fixed to an axle 50 which spans the Y-shaped end of the frame 18. The spring 30 is fixed approximately in the middle of the top side of the frame 18. Ten screws 31–40 are used to fix various elements of the invention to the frame 18.

The cover 10 in FIG. 1 includes an insulating gasket 11 and an inset plate 42. The insulating gasket 11 is fabricated from rubber and circumscribes the inset plate 42. The inset plate 42 has dimensions which allow it to fit inside the socket of an electronic module when the plug is removed from it. The rest of the cover 10 and gasket 11 are pressed against the walls of the socket to act as an RFI shield in the manner described below.

Figure 2:
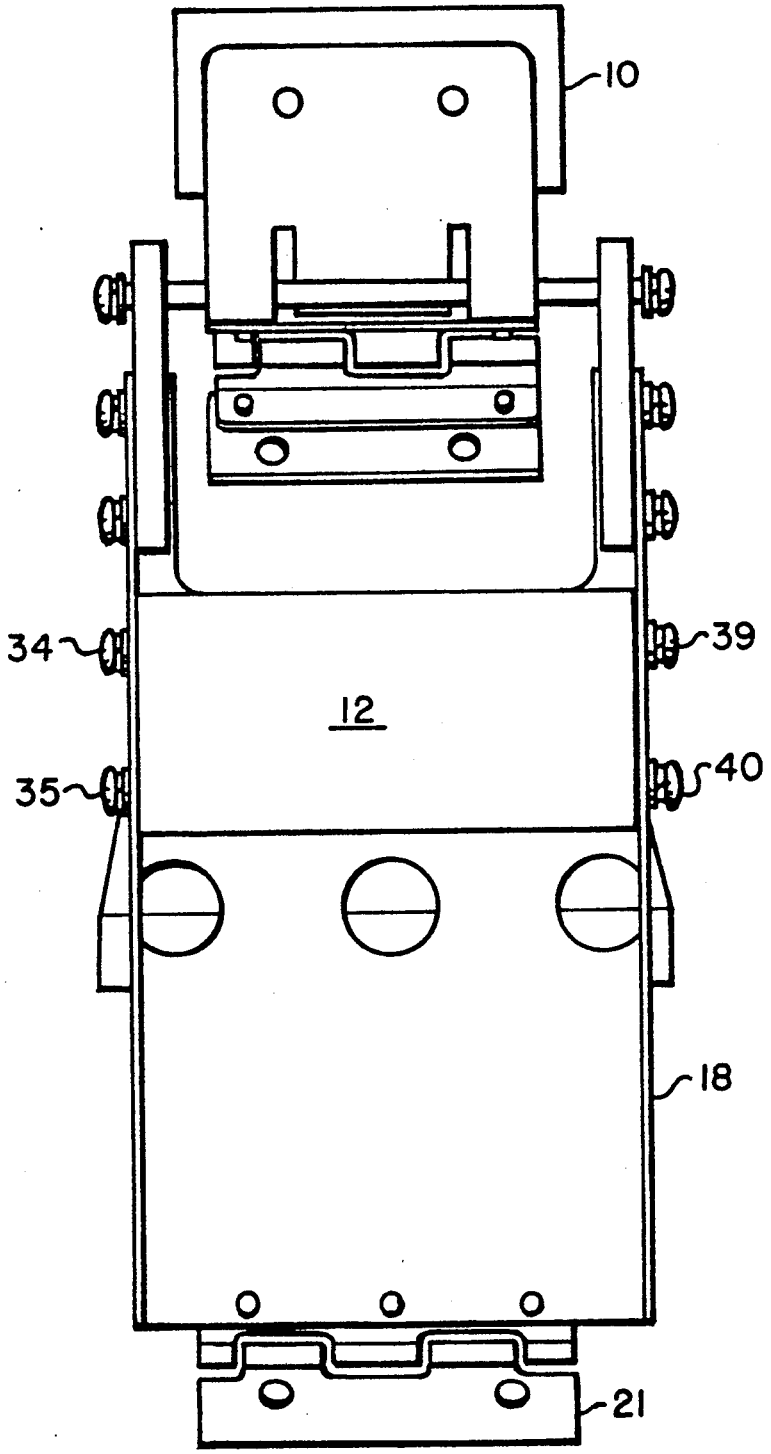
FIG. 2 is an underside view of the system of FIG. 1.

FIG. 2 is a view of the bottom side of an embodiment of the present invention. The purpose of FIG. 2 is to illustrate the location of the cam 12 which is fixed to the bottom side of the frame 18 directly beneath the spring 30 which is on the top side of the frame. These elements operate so that the cover 10 will be spring biased to press against an empty electrical socket, and will be unbiased when a plug is inserted in the electrical socket. This method of operation will be further explained in the discussion that follows.

Figure 3:
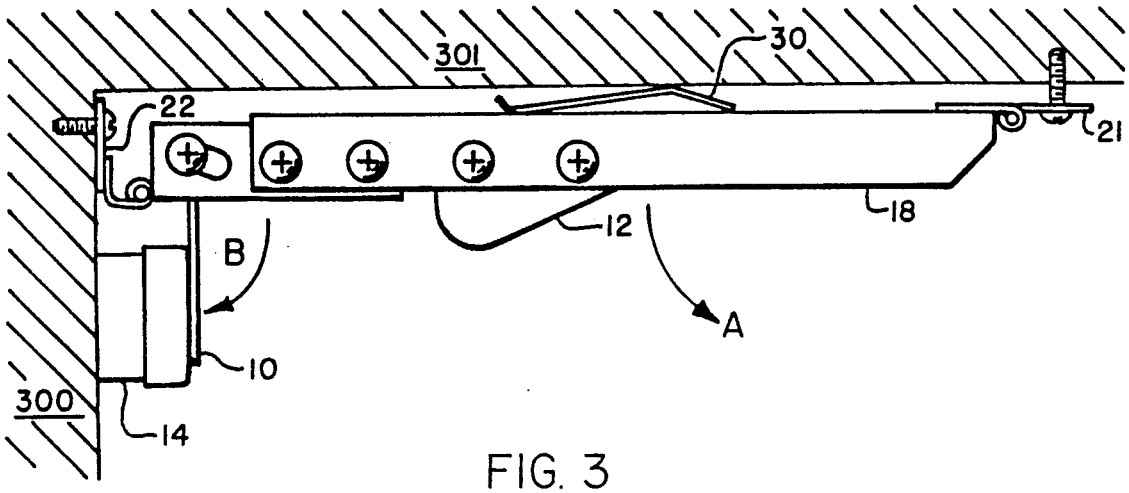
FIG. 3 is a side view of the system of FIGS. 1 and 2 when the cover is extended.

The reader's attention is now directed towards FIG. 3, which is a side view of the present invention in use as the cover 10 covers an empty electrical module socket 14. The frame 18 is mounted to a horizontal shelf 301 by the first hinge 21 at its rectangular end, and to the vertical rack 300 by the second hinge 22 at its Y-shaped end. The spring 30 on the top side of the frame 18 pushes against the shelf 301 to cause a first moment A, as the frame 18 pivots about the first hinge 21.

As shown in FIG. 1, the second hinge 22 and the cover 10 are connected to the Y-shaped end of the frame 18 by an axle 50 and two screws 31 and 36. These two screws and the axle are in an oval shaped slot in the frame which permits the Y-shaped end to be moved by the spring 30 as it presses against the horizontal shelf 301. Since the second hinge 22 is fixed to the vertical rack 300, this slight downward movement of the Y-shaped end of the frame 18 causes the cover to pivot in a second movement B which rotates the cover with constant pressure against the empty socket 14.

It is important to note that the Y-shaped end of the frame 18 is capable of a slight amount of vertical movement with respect to the horizontal shelf 301. The reason that this movement is possible is because the hinge 22 is fixed to the frame 18 by a set of screws 31 and 36 which protrude through oval shaped slots in the frame 18. These oval shaped slots allow the Y-shaped end of the frame to moved away from the shelf 301 by the spring 30. The frame 18 can also be pushed up against the shelf 301 to retract the cover 10 from the socket 14, in the manner discussed below.

Figure 4:
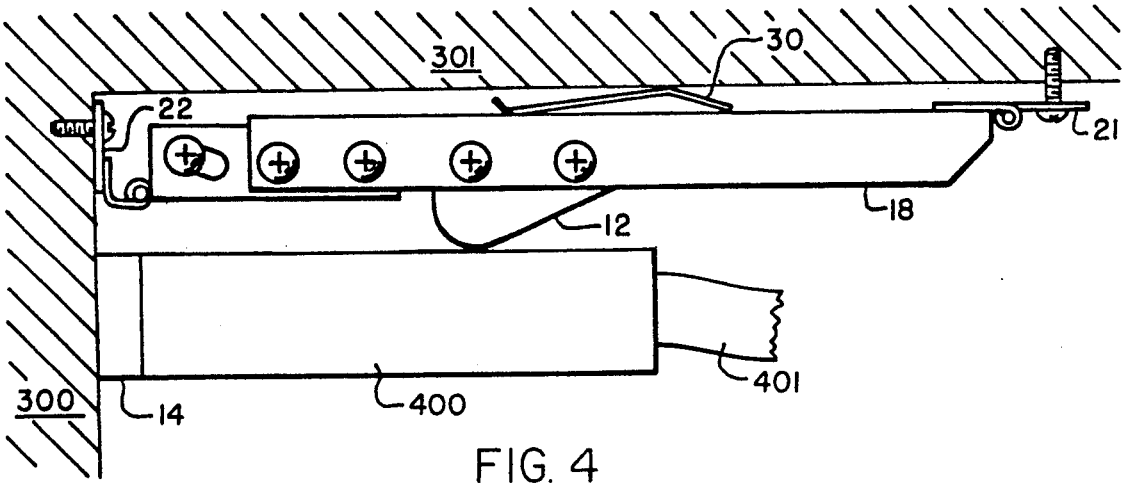
FIG. 4 is a side view of the system of FIG. 3 when the cover is retracted.

FIG. 4 is a side view of the present invention when the cover is retracted. In FIG. 4 a rectangular plug 400 is inserted into the socket 14 of the module. Note that the rectangular plug 400 is pressed up against the cam 12 of the invention when plugged in. This causes the Y-shaped end of the frame 18 to move upwards as the spring 30 is compressed. This slight upward movement causes the cover (not visible in FIG. 4) to rotate upwards and is retracted into the Y-shaped end of the frame 18. This retraction of the cover occurs since the cover is fixed to the hinge 22 and they both commonly pivot about an axle 50 connected to the frame 18 by screws 31 and 36. The upward movement of the frame 18 (caused as the plug 400 pushes against the cam 12) retracts the cover and rotates it upwards; while a downward movement of the frame 18 causes the cover to rotate downwards and forwards as depicted in FIG. 3.

Figure 5:
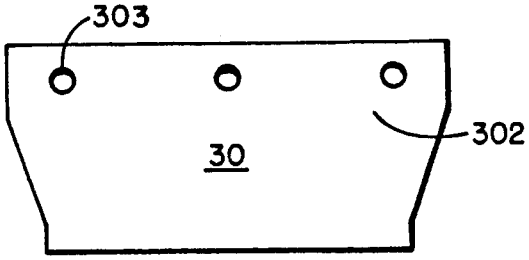
FIG. 5 is a plan view of the spring used in the present invention.

FIG. 5 is a plan view of the spring 30 which is fixed to the top of the frame 18 of FIG. 1. In this embodiment the spring is a bent metal plate which may be screwed to the frame through holes 303 or by any other method such as adhesives or tape. The bent plate of FIG. 5 is made of copper, and has a central crease 302 which is deflected when the frame is pushed towards the shelf above it. The spring 30 thereby tends to push the frame away from the shelf as described above.

Figure 6:
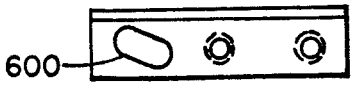
FIG. 6 is a detailed side view of the Y-shaped end of the frame of FIG. 1.

FIG. 6 is a detailed side view of the Y-shaped end of the frame 18. The purpose of FIG. 6 is to illustrate the oval shaped slot 600 through which screws fix the axle to the frame 18. This oval shaped slot 600 permits the Y-shaped end to move up and down with respect to the shelf above the frame.

Figure 7:
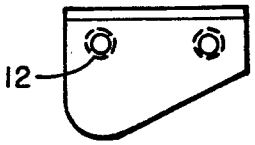
FIG. 7 is a side view of the cam based on the present invention.

FIG. 7 is a detailed side view of the cam 12 used in the invention. It may be made of plastic and is fixed to the bottom of the frame. As described above, the present invention provides a cam operated, spring loaded, RFI gasketted cover, which is actuated by the mating module just prior to its engagement with the panel mounted connector. The gasketed cover mates with the open connector shell with sufficient pressure to prevent leakage of secure electronic information through the unused connector when adjacent connectors/modules are being serviced.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A retractable protective cover system for covering and sealing an electrical socket of an electronic module when its plug is removed, said retractable protective cover system comprising:

a frame;

a protective cover which is fixed to said frame, and which has an insulating gasket which can cover and shield said socket to prevent radio frequency emanations from being emitted from said socket when said plug is removed;

a means for extending said protective cover so that it automatically covers said socket when said plug is removed; and a means for retracting said cover so that it automatically is retracted from said socket when said plug is in place.

2. A retractable protective cover system, as defined in claim 1, wherein said frame includes a rectangular end, and a Y-shaped end which is opposite said rectangular end, said Y-shaped end having an axle disposed through it to which said protective cover is fixed such that said protective cover may rotate so that it is approximately perpendicular to said frame when it is extended, and said protective cover may rotate back within the Y-shaped end's confines when it is retracted.

3. A retractable protective cover system, as defined in claim 2, wherein said electronic module which houses said socket is fixed to a shelf which extends out perpendicularly to said electronic module, and wherein said retractable protective cover system includes a means for fixing said frame to said shelf in proximity with said socket so that said protective cover can cover said socket when said plug is removed.

4. A retractable protective cover system, as defined in claim 3, wherein said fixing means comprises a first hinge which is fixed to said rectangular end of said frame and to said shield so that said Y-shaped end of said frame is pivotally fixed in proximity with said socket.

5. A retractable protective cover system, as defined in claim 4, wherein said extending means comprises:

a spring which is fixed to said frame so that it pushes the Y-shaped end of said frame away from said shelf; and a second hinge which is pivotally connected with said axle in said Y-shaped end of said frame and which is rigidly fixed to said protective cover and to said module so that when said spring pushes the Y-shaped end of said frame away from said shelf with a small movement, this movement causes the protective cover to be rotated about said axle sot hat the protective cover is extended towards the socket and covers the socket until the frame is pushed upwards by an external force.

6. A retractable protective cover system, as defined in claim 5, wherein said retracting means comprises a cam which is fixed to said frame such that when a plug is installed in said socket, said plug pushes said cam and said frame towards said shelf to compress said spring and retract said protective cover away from said socket.

7. A retractable protective cover system, as defined in claim 6, wherein said protective cover comprises:

a metal shell which is pivotally connected to said axle of said Y-shaped end of said frame, said metal shell having a shape with dimensions which fit over said socket;

a rubber insulating gasket which is fixed to the metal shell's interior so that it can shield said socket when said metal shell covers said socket; and an inset plate which is fixed on top of said rubber insulating gasket on the metal shell's interior, said inset plate having dimensions approximately equaling those of said plug so that said inset plate can fit inside said socket to help seal it.

8. A retractable protective cover system, as defined in claim 7, wherein said axle is fixed in said Y-shaped end of said frame by a pair of screws which protrude into a pair of oval shaped slots in said frame, said oval shaped slots permitting said frame to be moved away from said shield by said spring, and to be moved towards said shelf by said plug when it pushes on said cam.

9. A retractable protective cover system, as defined in claim 1, wherein said electronic module which houses said socket is fixed to a shelf which extends out perpendicularly to said electronic module, and wherein said retractable protective cover system includes a means for fixing said frame to said shelf in proximity with said socket so that said protective cover can cover said socket when said plug is removed.

10. A retractable protective cover system, as defined in 3, wherein said fixing means comprises a first hinge which is fixed to said rectangular end of said frame and to said shield so that said Y-shaped end of said frame is pivotally fixed in proximity with said socket.

11. A retractable protective cover system, as defined in claim 10, wherein said extending means comprises:

a spring which is fixed to said frame so that it pushes the Y-shaped end of said frame away from said shelf; and a second hinge which is pivotally connected with said axle in said Y-shaped end of said frame and which is rigidly fixed to said protective cover and to said module so that when said spring pushes the Y-shaped end of said frame away from said shelf with a small movement, this movement causes the protective cover to be rotated about said axle so that the protective cover is extended towards the socket and covers the socket until the frame is pushed upwards by an external force.

12. A retractable protective cover system, as defined in claim 11, wherein said retracting means comprises a cam which is fixed to said frame such that when a plug is installed in said socket, said plug pushes said cam and said frame towards said shelf to compress said spring and retract said protective cover away from said socket.

13. A retractable cover system for covering and sealing an electrical socket which is fixed in a wall when its plug is removed, said retractable protective cover system comprising:

a frame which is fixed to said wall and which has a rectangular end, and a Y-shaped end which is opposite said rectangular end, said Y-shaped end having an axle disposed through it;

a protective cover which is fixed to said axle in said frame, such that said protective cover may rotate so that it is approximately perpendicular to said frame when it is extended, and said protective cover may rotate back within the Y-shaped end's confines when it is retracted;

a shelf which is fixed to said wall above said socket and which is perpendicular to said wall;

a means for extending said protective cover so that it automatically covers said socket when said plug is removed; and a means for retracting said cover so that it automatically is retracted from said socket when said plug is in place.

14. A retractable protective cover system, as defined in claim 13, which includes a first hinge which is fixed to said rectangular end of said frame and to said shelf so that said Y-shaped end of said frame is pivotally fixed in proximity with said socket.

15. A retractable protective cover system, as defined in claim 14 wherein said extending means comprises:

a spring which is fixed to said frame so that it pushes the Y-shaped end of said frame away from said shelf; and a second hinge which is pivotally connected with said axle in said Y-shaped end of said frame and which is rigidly fixed to said protective cover and to said module so that when said spring pushes the Y-shaped end of said frame away from said shelf with a small movement, this movement causes the protective cover to be rotated about said axle so that the protective cover is extended towards the socket and covers the socket until the frame is pushed upwards by an external force.

16. A retractable protective cover system, as defined in claim 15, wherein said retracting means comprises a cam which is fixed to said frame such that when a plug is installed in said socket, said plug pushes said cam and said frame towards said shelf to comprises said spring and retract said protective cover away from said socket.

17. A retractable protective cover system, as defined in claim 16, wherein said protective cover comprises:

a metal shell which is pivotally connected to said axle of said Y-shaped end of said frame, said metal shell having a shape with dimensions which fit over said socket;

a rubber insulating gasket which is fixed to the metal shell's interior so that it can shield said socket when said metal shell covers said socket; and an inset plate which is fixed on top of said rubber insulating gasket on the metal shell's interior, said inset plate having dimensions approximately equaling thou of said plug so that said inset plate can fit inside said socket to help seal it.

18. A retractable protective cover system, as defined in claim 17, wherein said spring comprises a bent metal plate which is fixed to the frame and which has a central crease which is deflected as said frame is pushed towards said shelf, said bent metal plate thereby tending to push said frame away from said shelf.

19. A retractable protective cover system, as defined in claim 17, wherein said axle is fixed in said Y-shaped end of said frame by a pair of screws which protrude into a pair of oval shaped slots in said frame, said oval shaped slots permitting said frame to be moved away from said shield by said spring, and to be moved towards said shelf by said plug when it pushes on said cam.

20. A retractable protective cover system, as defined in claim 19, wherein said spring comprises a bent metal plate which is fixed to the frame and which has a central crease which is deflected as said frame is pushed towards said shelf, said bent metal plate thereby tending to push said frame away from said shelf.

* * * * *